United States Patent [19]

Latimer

[11] Patent Number: 4,676,071

[45] Date of Patent: Jun. 30, 1987

[54] WATER COOLED REFRIGERANT CONDENSER

[76] Inventor: Maurice E. Latimer, 819 Stadium, Port Arthur, Tex. 77640

[21] Appl. No.: 853,175

[22] Filed: Apr. 17, 1986

[51] Int. Cl.[4] ..... F25B 1/00; F25B 39/04

[52] U.S. Cl. ..... 62/225; 62/183; 62/305; 62/506

[58] Field of Search ..... 62/183, 305, 506, 115

[56] References Cited

U.S. PATENT DOCUMENTS

| | | | |
|---|---|---|---|
| 1,933,703 | 11/1933 | Brus et al. | 62/305 |
| 2,649,698 | 8/1953 | Goldmann | 62/506 X |
| 3,922,880 | 12/1975 | Morris | 62/506 X |

*Primary Examiner*—Lloyd L. King

*Attorney, Agent, or Firm*—Neal J. Mosely

[57] ABSTRACT

A liquid cooled refrigerant condenser comrpises an enclosure with an upper chamber and a lower chamber forming a partitioned liquid reservoir containing cooling liquid. The enclosure contains a refrigerant condensing manifold with an inlet pipe for receiving refrigerant gas from a compressor, an intermediate portion disposed within the lower chamber and submerged in the liquid, and an outlet portion for conducting the refrigerant gas to an evaporator coil. The manifold inlet pipe is coiled in a square helical coil above the liquid level in the reservoir. A blower mounted at the top of the enclosure directs the flow of air onto the liquid reservoir at sufficient velocity to entrain some of the liquid and direct a mixture of liquid and air onto the coiled inlet pipe of the manifold to remove heat from hot refrigerant gas passing through the coiled manifold. The blower also evaporates liquid in the partitioned reservoir sufficient to maintain each compartment at successively cooler temperatures and to remove additional heat in successive stages from the refrigerant gas passing through the intermediate portion of the condensing manifold.

15 Claims, 4 Drawing Figures

WATER COOLED REFRIGERANT CONDENSER

BACKGROUND OF THE INVENTION

1. FIELD OF THE INVENTION

This invention relates generally to water cooled refrigerant condensers, and more particularly to a water cooled refrigerant condenser which does not require a water pump for circulation of the cooling water.

2. BRIEF DESCRIPTION OF THE PRIOR ART

Water cooled refrigerant condensers are known in the art. There are several patents which disclose condensing units which utilize the evaporation process to remove heat from a refrigerant gas.

Baumann, U.S. Pat. No. 1,920,675 discloses a system for regulating the quantity and flow of water through a condenser with thermostats at the inlet and exit to maintain a substantially constant difference between the water flowing to and the water leaving the condenser.

Young et al, U.S. Pat. No. 2,220,594 discloses a self contained air conditioning unit separated into four vertical compartments. The lower compartment contains a motor and compressor. The compartment above the compressor contains an air intake vent, a condenser and drip pan. A portion of the condenser coil runs through the drip pan. The compartment above the condenser contains a motor and fan. The top compartment contains an exhaust grill. Air enters from the floor level and passes through the unit and exits near the ceiling.

Buehler, Jr., U.S. Pat. No. 2,911,801 discloses a condenser having a reservoir at the bottom of the enclosure beneath an air impervious panel for supporting the compressor. The refrigerant condenser is disposed above the reservoir and encompasses the compressor. A motor and pump constantly recirculates the liquid from the reservoir through a perforated header where it will gravitate over the coil back to the reservoir. A fan blows air downwardly into the enclosure and the air impervious panel above the reservoir directs the air through the coil.

Koch, U.S. Pat. No. 2,919,559 discloses a cooling system in which water is sprayed downward into an enclosure open top over a coil. The water creates a draft pulling air in and cools the sprayed water as a result of evaporation. The lower portion of the coil is surrounded by a water-de-entraining section which filters out water and alows air to circulate therethrough. The water is collected in a basin and pumped back through the spray means. The coil may also be disposed completely in the basin portion. A fan may be provided at the top for greater cooling.

Paugh, U.S. Pat. No. 3,165,902 discloses a water tower wherein an enclosure has evaporative pads in side openings and reservoir at the bottom. A fan and fin type coolant conducting coil are disposed within the enclosure. The fan creates a flow of air through the pads and through the coil and out through openings at the top. A pump in the reservoir recirculates water through the pads.

Goettl, U.S. Pat. No. 3,913,345 discloses a combination refrigeration type and spaced evaporative type air conditioner. The evaporative unit has evaporative pads in the inlet, a fan, a pump, and a reservoir reservoir at the bottom. The refrigeration unit has a fan and coolant conducting coil within the enclosure. The fan in the evaporator unit pulls air through the pad and directs it toward the coil of the refrigeration unit and the fan in the refrigeration unit pulls the cooled air through the coil. A pump in the reservoir recirculates water through the pad.

Gygax, U.S. Pat. No. 2,353,233 discloses a heat exchanger having a blower, motor, a water spray humidifier, a water reservoir at the bottom, and three coils to cool the refrigerant passing therethrough in stages. The humidifier comprises a spray nozzle which sprays water onto plurality of porous screens and the water is collected in the reservoir at the bottom of the enclosure. The first coil is located at the inlet of the enclosure, the second coil above the humidifier, and the coil is disposed at the bottom within the reservoir. Air is pulled through the first coil, across the reservoir, and upwardly through the humidifier screens and onto the second coil. The refrigerant is cooled first by the air passing through the first coil, then by the moist air from the humidifier passing through second coil, and then finally by the third coil immersed in the liquid reservoir.

The present invention is distinguished over the prior art in general, and these patents in particular by a water cooled refrigerant condenser comprising an enclosure having an upper chamber and a lower chamber forming a partitioned water reservoir containing a predetermined level of water. The enclosure contains a refrigerant condensing manifold having an inlet pipe for receiving refrigerant gas from a compressor, an intermediate portion disposed within the lower chamber and submerged in the liquid, and an outlet portion for conducting the refrigerant gas to an evaporator coil.

The manifold inlet pipe is coiled in square helical coil above the liquid level in the reservoir and a blower is mounted at the top of the enclosure for directing the flow of air onto the liquid reservoir at sufficient velocity to entrain some of the liquid and direct a mixture of liquid and air onto the coiled inlet pipe of the manifold and thereby remove heat from hot refrigerant gas passing through the square helical coiled portion. The blower also simultaneously creates evaporation of the liquid in the partitioned reservoir sufficient to maintain each compartment at successively cooler temperatures and thereby remove additional heat in successive stages from the refrigerant gas passing through the intermediate portion of the condensing manifold.

SUMMARY OF THE INVENTION

It is therefore an object of the present invention to provide a water cooled refrigerant condenser which effectively utilizes a novel refrigerant manifold arrangement and evaporative cooling effects of water and air at high velocity to increase efficiency and reduce electrical energy requirements.

It is another object of this invention to provide a water cooled refrigerant condenser which may be used with conventional refrigerant gas compressors and evaporator coils.

Another object of this invention is to provide a water cooled refrigerant condenser which is capable of being connected to the supply and return lines of an evaporator coil requires only water and electrical power sources.

Another object of this invention is to provide a water cooled refrigerant condenser in which the motor and compressor are not exposed to the moisture producing section of the unit thus reducing corrosive deterioration thereof.

Another object of this invention is to provide a water cooled refrigerant condenser utilizing a blower for directing the flow of air onto a partitioned liquid reservoir at sufficient velocity to entrain some of the liquid and direct a mixture of liquid and air onto a coiled portion of the manifold to transfer heat at the inlet portion of the manifold and simultaneously creating evaporation of the liquid in the partitioned reservoir sufficient to maintain each compartment at successively cooler temperatures and thereby remove additional heat in successive stages from the refrigerant gas passing through an intermediate portion of the manifold.

Another object of this invention is to provide a water cooled refrigerant condenser which does not require a liquid pump or closed water circulation system.

A still further object of this invention is to provide a water cooled refrigerant condenser which is simple in construction, economical to manufacture, and rugged and durable in use.

Other objects of the invention will become apparent from time to time throughout the specification and claims as hereinafter related.

The above noted objects and other objects of the invention are accomplished by the present water cooled refrigerant condenser having a novel refrigerant manifold arrangement and utilizing evaporative cooling effects of water and air at high velocity.

DESCRIPTION OF THE PREFERRED EMBODIMENT

Figure 1:
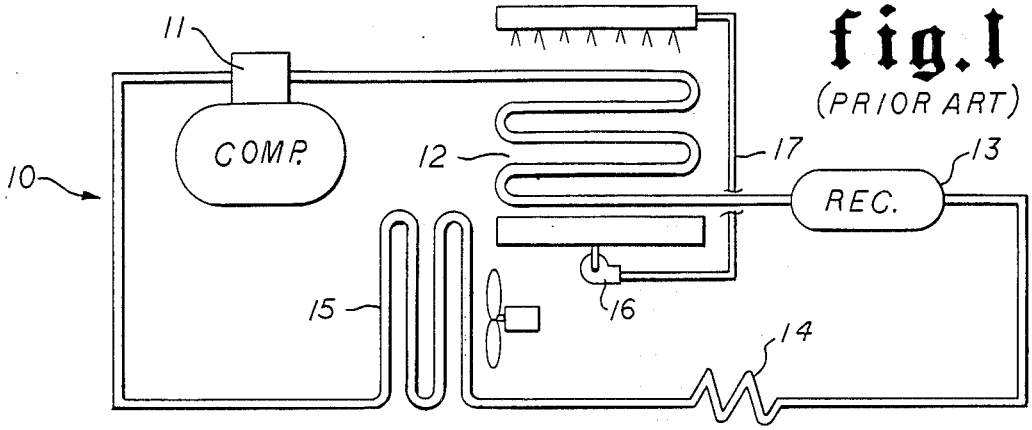
fig.1 (PRIOR ART)
FIG. 1 is a schematic diagram of a conventional refrigeration or air-conditioning system of the prior art.

Referring to the drawings by numerals of reference, there is shown in FIG. 1, a conventional refrigeration or air-conditioning system 10 of the prior art. The basic components of the conventional system comprise; a compressor 11, a condenser 12, a receiver 13, an expansion device 14 in the form of an expansion valve or capillary, and an evaporator coil 15. Conventional water cooled systems additionally require a pump 16 and a controlled circulation system 17. The present water cooled condenser eliminates the need for a pump and a controlled circulation system.

Figure 2:
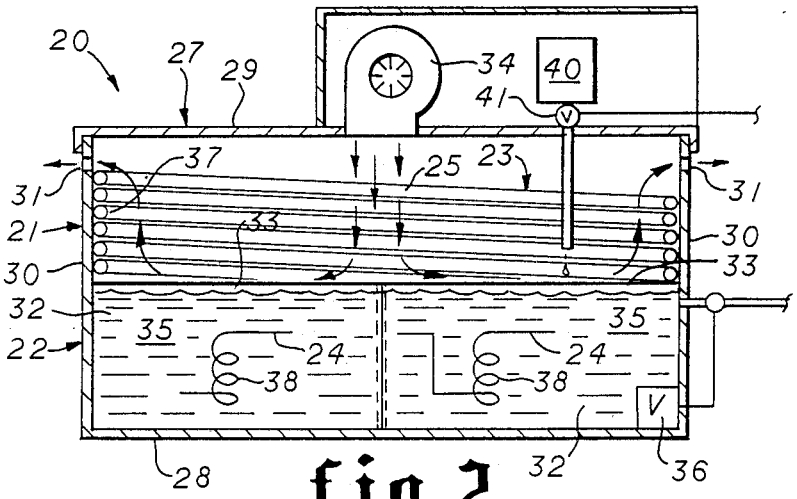
FIG. 2 is a side elevation in cross section of the water cooled condenser of the present invention.
Figure 3:
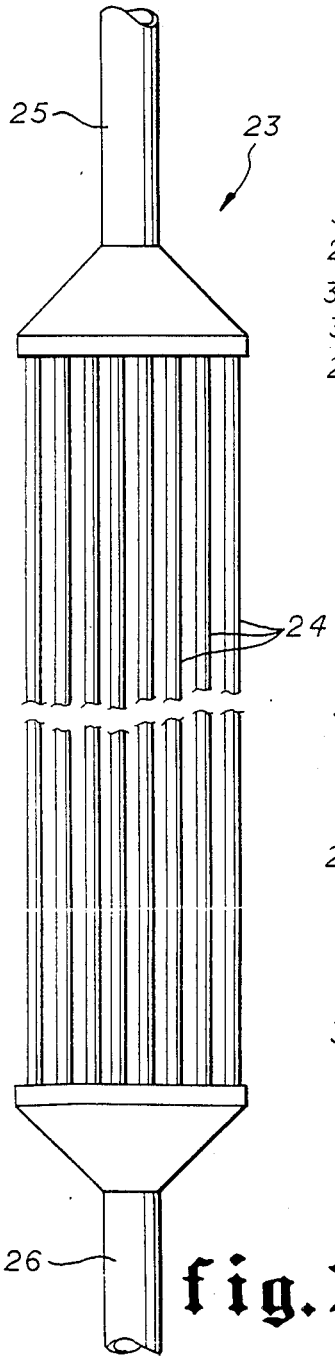
FIG. 3 is a side elevation of a portion of the condenser tubing manifold.
Figure 4:
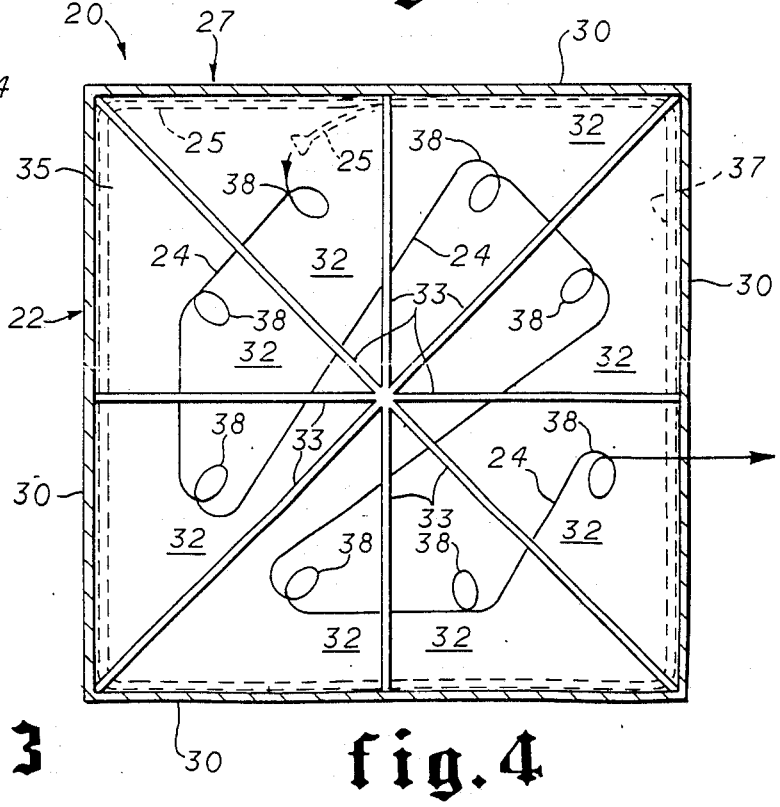
FIG. 4 is a top plan view of the tower portion of the condensing chamber of the present invention.

Referring now to FIGS. 2, 3, and 4, the present invention comprises a water cooled condenser 20 having an upper chamber 21 and lower chamber or reservoir 22, and condenser tubing in the form of a manifold 23 disposed within the two chambers. As shown in FIG. 3, the condenser tubing manifold 23 comprises a plurality of small diameter tubes 24 connected at each end between an inlet header pipe 25 and outlet header pipe 26 of larger diameter tubing. A typical size relationship of the manifold tubing members would be for example; a plurality of eight 3/16" diameter tubes 24 for the smaller tubing or intermediate portion with headers 25 and 26 being ¾" diameter pipes.

As best seen in FIGS. 3 and 4, the water cooled condenser 20 comprises a rectangular or square enclosure 27 having a bottom panel 28, a top cover 29, and four side walls 30. Exhaust vents 31 are provided near the top of the side walls 30 to exhaust air from the interior of the condenser. The lower chamber or reservoir 22 is divided into eight separate compartments or sub-chambers 32 by a plurality of vertical walls or divider plates 33 which extend radially outward from the center of the lower chamber. The divider plates 33 extend vertically a distance from the bottom panel 28 with the diagonal plates terminating at each corner of the chamber and the remaining plates terminating at the side walls 30 bisecting the angle formed by the diagonal plates to form the eight compartments or sub-chambers 32. A squirrel cage blower 34 is mounted on the top cover 29 with the exhaust portion centered vertically above the center junction of the divider plates 33.

The eight sub-chambers 32 are filled with water 35 to a level just below their top edges. A suitable fill valve 36 connected to a water supply source (not shown) is provided within the reservoir to maintain the level of water in the sub-chambers 32 relatively constant. Because of the air velocity of the blower 34 and evaporation of the water in the sub-chambers 32, a preferred valve is one which will allow water to enter responsive to the weight of the water reaching a predetermined limit. Such a valve would be more reliable than a conventional float valve.

The inlet header pipe 25 is connected to the discharge side of a remote compressor (not shown). In the upper chamber 21 of the condenser above the divider plates 33, the inlet header pipe 25 is helically wound to form a square coil 37 within the side walls 30. The plurality of smaller tubes 24 of the intermediate manifold portion extend through the divider plates 33 and are wound into coils 38 within each of the sub-chambers 32. The outlet header pipe 26 is connected to the cooling coils (not shown) in the building being served by the condenser 20. The return line from the cooling coils is connected to the compressor to complete the refrigerant piping system.

To increase the efficiency of evaporative cooling of the compressor, an alcohol dispensing system may be optionally installed. The alcohol dispensing system comprises a container 40 filled with an evaporative solvent such as alcohol disposed above the last, or coolest sub-chamber 32. An electrically controlled valve 41 installed in the outlet line of the container is operatively connected to the compressor. When the compressor is running, the valve 41 will open allowing a predetermined amount of alcohol to drip into the water in the last sub-chamber. The alcohol dispensing system is particularly helpful on very hot days when the humidity is high resulting in less efficient evaporation. The alcohol and water mixture requires less heat to cause evaporation and increases the cooling capacity of the system.

OPERATION

In operation, the discharge side of the compressor is connected to the square helical coiled inlet header pipe 25 of the manifold 23 and the outlet header pipe 26 is connected to the evaporator coil in the building being served. The return line from the evaporator coil is connected to the intake side of the compressor. The refrigerant piping system is charged with a suitable refrigerant gas such as Freon 22. The compressor raises the temperature of the gas, and the hot compressed gas from the compressor flows through the large diameter inlet header pipe 25 and successively into the plurality of coils 38 of small diameter tubes 24 submerged in the water in each sub-chamber 32.

The blower 34 draws in outside air and blows it down at relatively high velocity into the center of the enclosure onto the center of the divider plates 33 and equally into the separate sub-chambers 32. The air is allowed to exhaust through the vents 31 near the top of the side walls 30. The air which is blown from above circulates over each of the sub-chambers at a velocity sufficient to entrain some of the water and direct a mixture of water and air onto the helically coiled portion 37 of the manifold causing heat to be removed from the hot gas passing through the helically coiled portion of the manifold. The water being heavier than air falls back into the reservoir.

The blower also evaporates water in the reservoir sub-chambers sufficient to maintain the water in each sub-chamber at successively cooler temperatures to remove additional heat successively from the hot gas passing through the coils 38 of small diameter tubes submerged in the water. The plurality of small diameter coiled tubes provides increased surface area of the refrigerant piping immersed in the water to facilitate heat transfer.

Each sub-chamber is cooler than the last. The water in the last sub-chamber is cooler than the outside air due to the evaporation process. The removal of heat from the refrigerant in successive stages results in the refrigerant going back to the cooling coil can absorb more heat from the building in the next cycle. The indoor thermostat will turn the unit off more quickly thereby reducing the electric bill. The condenser of the present invention requires less electricity while running and provides more cooling per unit of electricity.

The water cooled condenser in accordance with the present invention provides a substantial increase in efficiency over conventional water cooled systems due to the order and arrangement of the manifold coils and the evaporative cooling effect of the water and air at high velocity to produce a substantial energy savings.

While this invention has been described fully and completely with special emphasis upon a preferred embodiment, it should be understood that within the scope of the appended claims the invention may be practiced otherwise than as specifically described herein.

I claim:

1. A refrigerant condensing method utilizing liquid evaporation comprising the steps of;

providing a condenser having an upper portion and a liquid reservoir therebelow containing a predetermined level of liquid, a refrigerant condensing manifold having a helically coiled inlet conduit portion helically coiled within said upper portion for receiving refrigerant gas from a compressor, an intermediate plurality of conduits submerged in said liquid, and an outlet conduit portion for conducting the refrigerant liquid to an evaporator coil, and air impelling means for directing the flow of air into condenser and onto the liquid reservoir, connecting the inlet conduit portion of the manifold to the discharge side of a compressor, the outlet conduit portion of the manifold to the evaporator coil of the building being served by the condensing unit, and the evaporator coil to the intake side of the compressor, and charging the system with a liquid refrigerant, compressing the refrigerant gas to a high pressure and circulating the same to said condenser, circulating ambient air into the liquid reservoir at a velocity sufficient to entrain some of said liquid and direct a mixture of liquid and air onto the helically coiled inlet conduit portion of said manifold to remove heat from hot refrigerant gas passing therethrough sufficient to convert the refrigerant gas to a refrigerant liquid, simultaneously impelling ambient air into the liquid reservoir at a velocity sufficient to evaporate some of the liquid in said reservoir to maintain said reservoir at a cool temperature to remove additional heat from the refrigerant liquid passing through said intermediate plurality of conduits of said condensing manifold, and thereafter conducting the refrigerant liquid through the outlet conduit portion of said manifold and through an evaporator coil and returning the evaporated refrigerant from the evaporator coil to the inlet side of the compressor.

2. A method according to claim 1 including the further step of selectively adding evaporative solvent to the liquid contained within said reservoir, said solvent having a boiling point below that of the liquid contained within said reservoir.

3. A refrigeration system comprising a compressor, condenser and expansion coil connected in series, said condenser comprising an enclosure having an upper chamber with exhaust vents and a lower chamber forming a liquid reservoir with a predetermined level of liquid therein, multi-stage cooling means for cooling and condensing hot compressed refrigerant flowing from refrigerant compressor comprising a refrigerant condensing manifold having an inlet conduit for receiving refrigerant gas from a compressor, an intermediate portion comprising multiple conduits disposed within said enclosure lower chamber and totally submerged in said liquid, and an outlet conduit for conducting the refrigerant gas to an evaporator coil, said inlet conduit disposed within said enclosure upper chamber and helically coiled above the liquid level in said reservoir, a fan for directing the flow of air into said enclosure lower chamber onto the liquid reservoir at sufficient velocity to entrain some of said liquid and direct a mixture of liquid and air onto the helically coiled portion of said manifold to remove heat from hot refrigerant gas passing therethrough, said fan being operable to evaporate liquid in said reservoir sufficient to maintain said reservoir at a cool temperature and removes additional heat from the refrigerant gas passing through said intermediate multiple conduits of said condensing manifold.

4. A liquid cooled refrigerant condenser comprising;

an enclosure having an upper chamber with exhaust vents and a lower chamber forming a liquid reservoir, a predetermined level of liquid within said reservoir, multi-stage cooling means for cooling and condensing hot compressed refrigerant flowing from refrigerant compressor, said multi-stage cooling means comprising a refrigerant condensing manifold having an inlet conduit for receiving refrigerant gas from a compressor, an intermediate portion comprising multiple conduits disposed within said enclosure lower chamber and totally submerged in said liquid, and an outlet conduit for conducting the refrigerant gas to an evaporator coil, said inlet conduit disposed within said enclosure upper chamber and helically coiled above the liquid level in said reservoir, a fan for directing the flow of air into said enclosure lower chamber onto the liquid reservoir at sufficient velocity to entrain some of said liquid and direct a mixture of liquid and air onto the helically coiled portion of said manifold to remove heat from hot refrigerant gas passing therethrough, said fan being operable to evaporate liquid in said reservoir sufficient to maintain said reservoir at a cool temperature and removes additional heat from the refrigerant gas passing through said intermediate multiple conduits of said condensing manifold.

5. A condenser according to claim 4 in which said refrigerant condensing manifold inlet and outlet conduits each comprise a larger tubular conduit member and the intermediate portion comprises a plurality of substantially smaller tubular conduit members connected at each end between said inlet and outlet conduits.

6. A condenser according to claim 4 in which said lower chamber forming a liquid reservoir receiving said manifold plurality of conduits is divided into a plurality of separate open ended sub-chambers each containing a portion of said liquid.

7. A condenser according to claim 6 in which said refrigerant manifold intermediate plurality of conduits is formed into a plurality of successive coils each disposed within a sub-chamber and submerged in said liquid.

8. A condenser according to claim 6 in which said lower chamber forming a liquid reservoir is divided into a plurality of separate open ended sub-chambers by a plurality of divider plates which extend vertically upward a distance from the bottom of said lower chamber and radially outward from the center of said lower chamber, and said sub-chambers are filled with said liquid to a level just below the top edges of said divider plates.

9. A condenser according to claim 4 including liquid control means for maintaining said liquid within said reservoir at a predetermined level.

10. A condenser according to claim 9 in which said liquid control means comprises a control valve disposed within said reservoir and operatively connected to a liquid supply source for allowing liquid to enter said reservoir from said source responsive to said liquid in said reservoir falling below a predetermined weight.

11. A condenser according to claim 9 in which said liquid control means comprises a control valve disposed within said reservoir and operatively connected to a liquid supply source for allowing liquid to enter said reservoir from said source responsive to said liquid in said reservoir falling below a predetermined level.

12. A condenser according to claim 4 further comprising solvent storage and dispensing means associated with said liquid reservoir for selecting dispensing a rapidly evaporating liquid into the liquid within said reservoir, said rapidly evaporating liquid having a boiling point below that of the liquid within said reservoir.

13. A condenser according to claim 12 in which said storage and dispensing means is operatively connected with a compressor whereby said rapidly evaporating liquid will be dispensed into the liquid within said reservoir when the compressor is running.

14. A condenser according to claim 13 in which said storage and dispensing means comprises a container filled with said rapidly evaporating liquid and having an outlet and an electrically controlled valve associated with said outlet and operating connected to the compressor.

15. A condenser according to claim 12 in which said rapidly evaporating liquid is dispensed into the liquid in said reservoir at a location near the end of the intermediate plurality of conduits of said condensing manifold.

* * * * *